US011070018B2

(12) United States Patent
Liao et al.

(10) Patent No.: US 11,070,018 B2
(45) Date of Patent: Jul. 20, 2021

(54) CRIMPING TOOL

(71) Applicant: Hanlong Industrial Co., Ltd., New Taipei (TW)

(72) Inventors: Chien-Chou Liao, New Taipei (TW); Chien-Wei Huang, New Taipei (TW)

(73) Assignee: Hanlong Industrial Co., Ltd., New Taipei (TW)

( * ) Notice: Subject to any disclaimer, the term of this patent is extended or adjusted under 35 U.S.C. 154(b) by 232 days.

(21) Appl. No.: 16/244,373

(22) Filed: Jan. 10, 2019

(65) Prior Publication Data

US 2020/0067249 A1 Feb. 27, 2020

(30) Foreign Application Priority Data

Aug. 24, 2018 (TW) ..... 107129682

(51) Int. Cl.
*H01R 43/042* (2006.01)
*B25B 27/14* (2006.01)

(52) U.S. Cl.
CPC ..... *H01R 43/042* (2013.01); *B25B 27/146* (2013.01)

(58) Field of Classification Search
CPC ..... B25B 27/146; H01R 43/042
See application file for complete search history.

(56) References Cited

U.S. PATENT DOCUMENTS

| | | | | |
|---|---|---|---|---|
| 5,647,119 | A * | 7/1997 | Bourbeau | H01R 43/042 29/751 |
| 7,225,532 | B2 * | 6/2007 | Wei | H01R 43/042 29/278 |
| 8,006,537 | B2 * | 8/2011 | Liu | B25B 27/10 72/409.14 |
| 10,263,377 | B2 * | 4/2019 | Ho | H01R 43/042 |
| 2011/0047790 | A1 * | 3/2011 | Peng | H01R 43/042 29/751 |
| 2020/0067249 | A1 * | 2/2020 | Liao | H01R 43/042 |

FOREIGN PATENT DOCUMENTS

| | | |
|---|---|---|
| CN | 201312056 Y | 9/2009 |
| TW | M310085 U | 4/2007 |

* cited by examiner

*Primary Examiner* — Minh N Trinh
(74) *Attorney, Agent, or Firm* — Karin L. Williams; Alan D. Kamrath; Mayer & Williams PC

(57) ABSTRACT

A crimping tool is disclosed. The crimping tool comprises a first handle, a second handle, a crimping member, a first mechanism link and a second mechanism link. The first handle comprises a hole and a first shaft portion, wherein the first shaft portion is adjacent to a top end of the first handle. The second handle comprises a second shaft portion, wherein the first shaft portion and the second shaft portion are connected by a shaft member. The crimping member is disposed on the first handle. The first and the second mechanism links are respectively connected with the first handle, the second handle and the crimping member such that when the first handle and the second tool are rotated with respect to each other, the crimping member is pushed to move from a first position to a second position.

12 Claims, 7 Drawing Sheets

CRIMPING TOOL

BACKGROUND OF THE INVENTION

1. Field of the Invention

The present invention relates to a crimping tool; more particularly, the present invention relates to a crimping tool for allowing the user to apply force more conveniently.

2. Description of the Related Art

As technology develops, many different types of crimping tools have been developed to install joints or connector ports of different sizes. Please refer to FIG. 1A-1B, which illustrate an operation view of the crimping tool of the prior art. The crimping tool 90 of the prior art comprises a first tool 91, a second tool 92, a crimping member 93, a connecting rod 94, and a plurality of pivots 951, 952, and 953. The first tool 91 has a hole 911, and the crimping member 93 is adjacent to the hole 911. The first tool 91 is connected with one end of the connecting rod 94 by the pivot 951, another end of the connecting rod 94 is connected with the second tool 92 by the pivot 952, and the second tool 92 is connected with the crimping member 93 by the pivot 953. Thus, when the first tool 91 and the second tool 92 are pressed as shown in FIGS. 1A and 1B, the crimping member 93 is moved by the connection of the first tool 91, the second tool 92, and the connecting rod 94. The joint or the connecting port to be installed can be placed in the hole 911 to be assembled by the crimping member 93.

However, a distance exists from the upper side of the pivot 953 of the crimping tool 90 to the top end of the first tool 91 in the prior art. Thus, the length of the arm is limited, which will cause the user to apply a larger force or increase the tool size. Therefore, it is necessary to invent a new crimping tool to mitigate and/or obviate the aforementioned problems.

SUMMARY OF THE INVENTION

It is an object of the present invention to provide a crimping tool for allowing the user to apply force more conveniently.

To achieve the abovementioned object, a crimping tool comprises a first handle, a second handle, a crimping member, a first mechanism link, and a second mechanism link. The first handle comprises a hole, a first grip portion, and a first shaft portion, wherein the first shaft portion is adjacent to a top end of the first handle. The second handle comprises a second grip portion and a second shaft portion, wherein the first shaft portion and the second shaft portion are connected by a shaft member. The crimping member is disposed at the first handle and adjacent to the hole. The second mechanism link is connected with the first mechanism link, wherein the first mechanism link and the second mechanism link are connected with the first handle, the second handle, and the crimping member respectively; thus, when the first grip portion and the second grip portion are pressed, the first handle and the second handle are rotated with respect to each other to push the crimping member to move from a first position to a second position.

DETAILED DESCRIPTION OF THE PREFERRED EMBODIMENT

The advantages and innovative features of the invention will become more apparent from the following detailed description when taken in conjunction with the accompanying drawings.

Figure 1A:
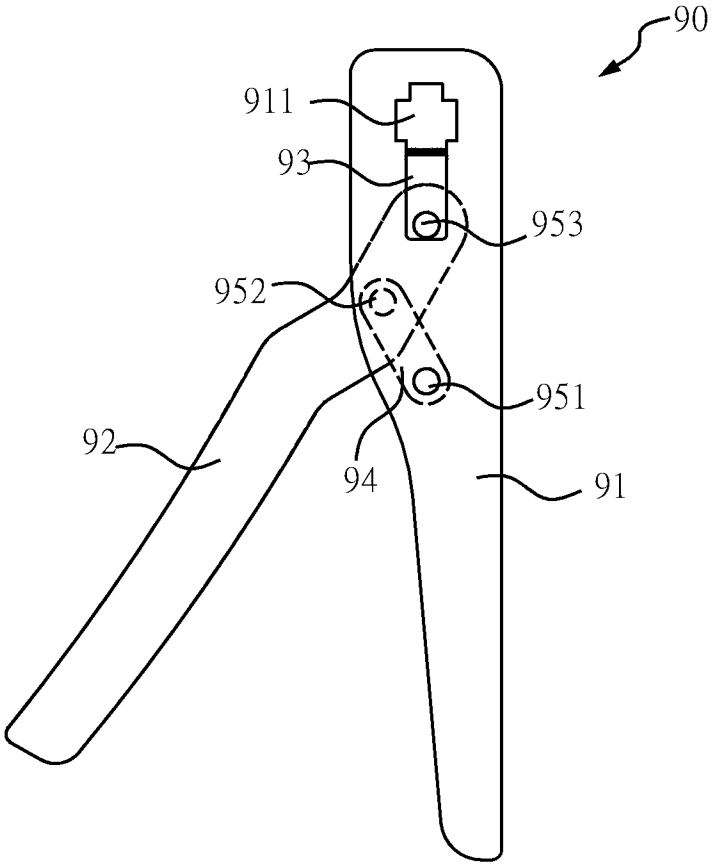
Fig. 1A(Prior Art)
FIGS. 1A-1B illustrate an operation view of the crimping tool of the prior art.
Figure 1B:
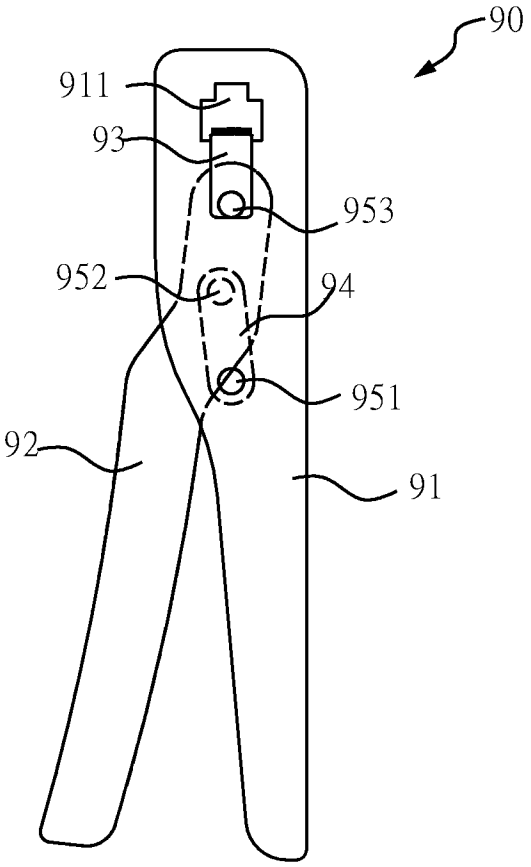
Fig. 1B(Prior Art)
Figure 2:
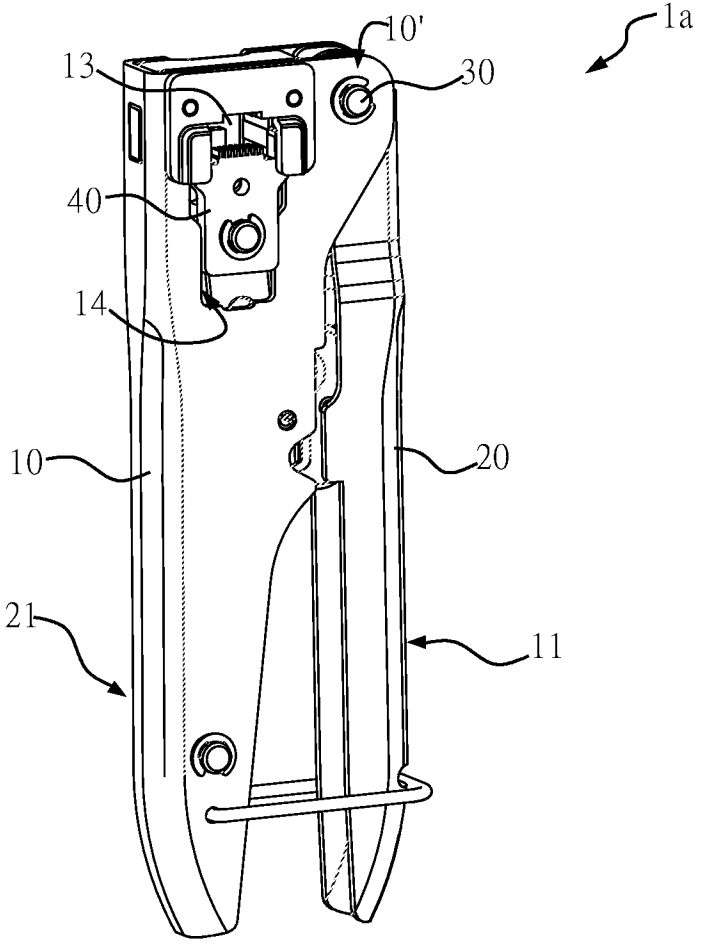
FIG. 2 illustrates a stereogram of a first embodiment of the crimping tool of the present invention.
Figure 3:
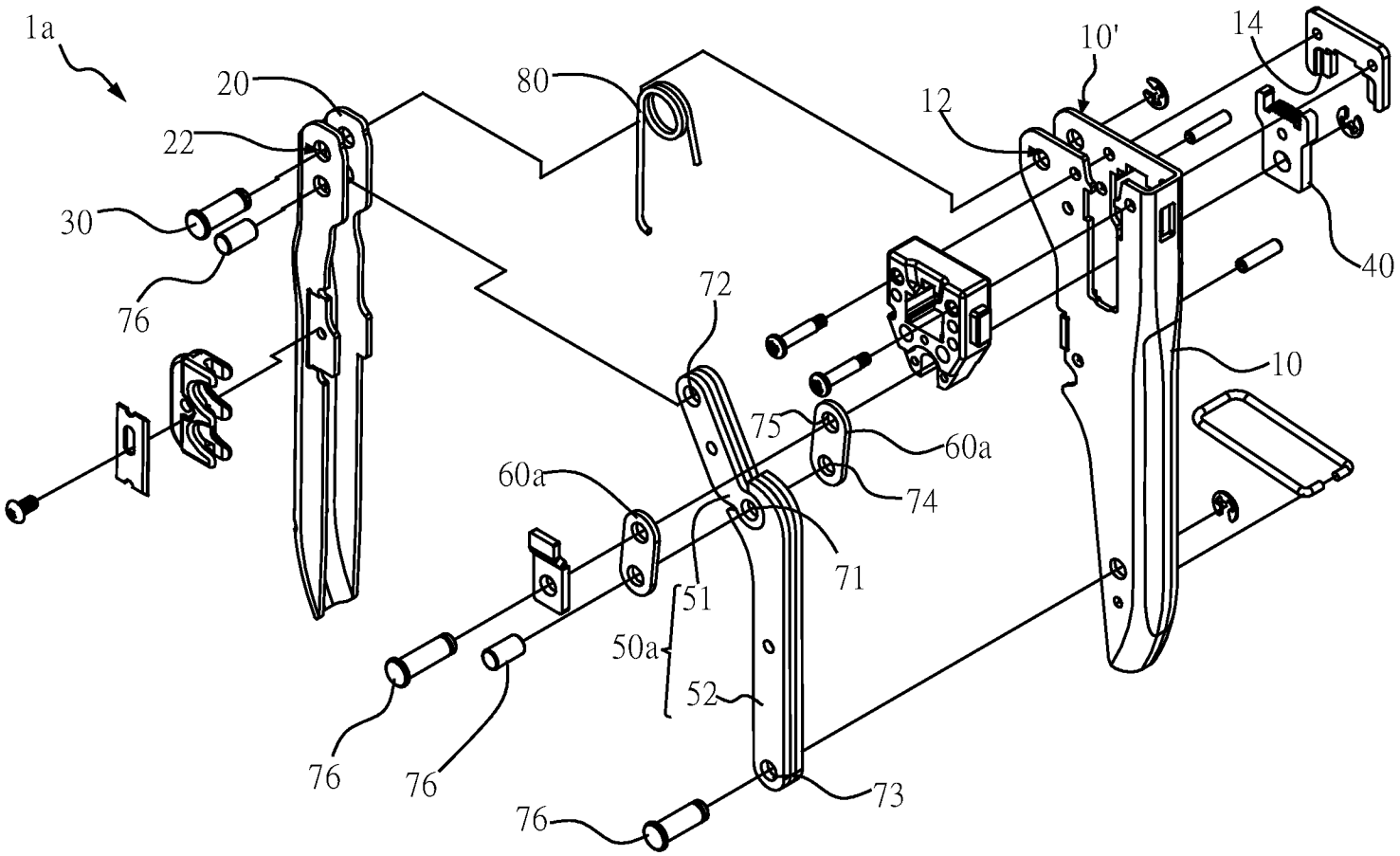
FIG. 3 illustrates an exploded view of the first embodiment of the crimping tool of the present invention.

Hereafter, please first refer to FIG. 2, which illustrates a stereogram of the first embodiment of the crimping tool of the present invention, and FIG. 3, which illustrates an exploded view of the first embodiment of the crimping tool of the present invention. It should be noted that although the following description uses the terms "first", "second", etc., to describe various elements, these elements should not be limited by the terms. These terms are only used to distinguish one element from another. For example, a first handle may be referred to as a second handle and a second handle may be referred to as a first handle without departing from the scope of the various described embodiments. Each of the first handle and the tool module is a tool, but they are not the same tool.

In the first embodiment of the present invention, a crimping tool 1*a* comprises a first handle 10, a second handle 20, a crimping member 40*a*, a first mechanism link 50*a*, and a second mechanism link 60*a*. The first handle 10 comprises a first grip portion 11, a first shaft portion 12, and a hole 13. The second handle 20 comprises a second grip portion 21 and a second shaft portion 22, wherein the first shaft portion 12 and the second shaft portion 22 are connected by a shaft member 30 and adjacent to a top end 10' of the first handle 10. Thus, when the first grip portion 11 and the second grip portion 21 are pressed, the first handle 10 and the second handle 20 are rotated with respect to each other by the shaft member 30.

The crimping member 40 is disposed at a sliding rail 14 of the first handle 10 and adjacent to the hole 13. The first mechanism link 50*a* is connected with the second mechanism link 60*a* and also connected with the first handle 10, the second handle 20, and the crimping member 40 respectively. Thus, when the first grip portion 11 and the second grip portion 21 are pressed, the first handle 10 and the second handle 20 are rotated with respect to each other by the shaft member 30 to push the crimping member 40 to move from a first position to a second position. Furthermore, an elastic element 80 is disposed between the first handle 10 and the second handle 20 to provide an elastic force after the first handle 10 and the second handle 20 are pressed. Therefore, when the first handle 10 and the second handle 20 are released, the first handle 10 and the second handle 20 will return to the original state and the crimping member 40 will return to the first position from the second position. The joint or the connecting port to be installed can be placed in the hole 13 to be assembled by the movement of the crimping member 40. The present invention does not limit the shape of the hole 13 and the crimping member 40.

Taking the exploded view shown in FIG. 3 as an example, the first mechanism link 50*a* of the crimping tool 1*a* comprises a first pivoting portion 71, a second pivoting portion 72, and a third pivoting portion 73; the second mechanism link 60*a* comprises a fourth pivoting portion 74 and a fifth pivoting portion 75. The second mechanism link 60*a* is made by two metal sheets so as to be disposed at the front and the back of the first mechanism link 50*a*, but the present invention is not limited thereto. Each of the pivoting portions is disposed on a pivot shaft 76, wherein the first pivoting portion 71 of the first mechanism link 50*a* is connected with the fourth pivoting portion 74 of the second mechanism link 60*a* by the same pivot shaft 76. In one embodiment of the present invention, the first mechanism link 50*a* comprises a first sub mechanism link 51 and a second sub mechanism link 52, wherein the second sub mechanism link 52 is pivotally connected with the first sub mechanism link 51 by a C-shaped connector. The first pivoting portion 71 and the second pivoting portion 72 are disposed at the first sub mechanism link 51; the third pivoting portion 73 is disposed at the second sub mechanism link 52. Thus, the first sub mechanism link 51 and the second sub mechanism link 52 are connected with each other and pivotally connected with the fourth pivoting portion 74 of the second mechanism link 60*a*.

Figure 4A:
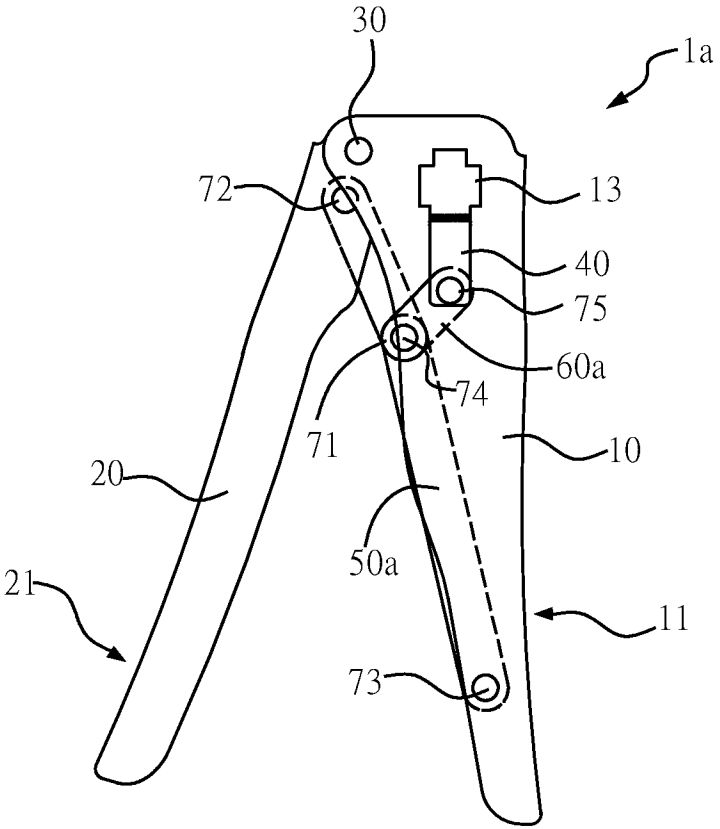
FIGS. 4A-4B illustrate an operation view of the first embodiment of the crimping tool of the present invention.
Figure 4B:
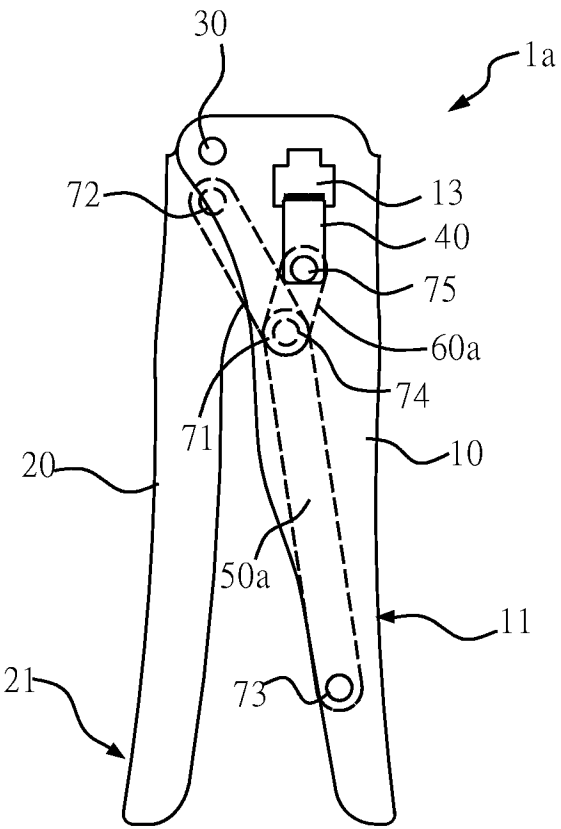

Please refer to FIGS. 4A-4B, which illustrate an operation view of the first embodiment of the crimping tool of the present invention.

The first mechanism link 50*a* is pivotally connected with the second handle 20 by the second pivoting portion 72. The first mechanism link 50*a* is pivotally connected with a portion adjacent to the first grip portion 11 on the first handle 10 by the third pivoting portion 73. The second mechanism link 60*a* is pivotally connected with the crimping member 40 by the fifth pivoting portion 75. The first pivoting portion 71 of the first mechanism link 50*a* is connected with the fourth pivoting portion 74 of the second mechanism link 60*a* by the same pivot shaft 76; thus, the first pivoting portion 71 and the fourth pivoting portion 74 are disposed at the same place. As a result, the first sub mechanism link 51 of the first mechanism link 50*a* can be rotated with respect to the second sub mechanism link 52, and the second mechanism link 60*a* can also be rotated with respect to the first mechanism link 50*a*. Therefore, when the first handle 10 and the second handle 20 are pressed to be rotated with respect to each other by the shaft member 30, the first sub mechanism link 51 and the second sub mechanism link 52 will be rotated at the same time; then the second mechanism link 60*a* will be rotated and pushed. Finally, the crimping member 40 will be moved from the first position to the second position by the pushing of the second mechanism link 60*a*.

Figure 5A:
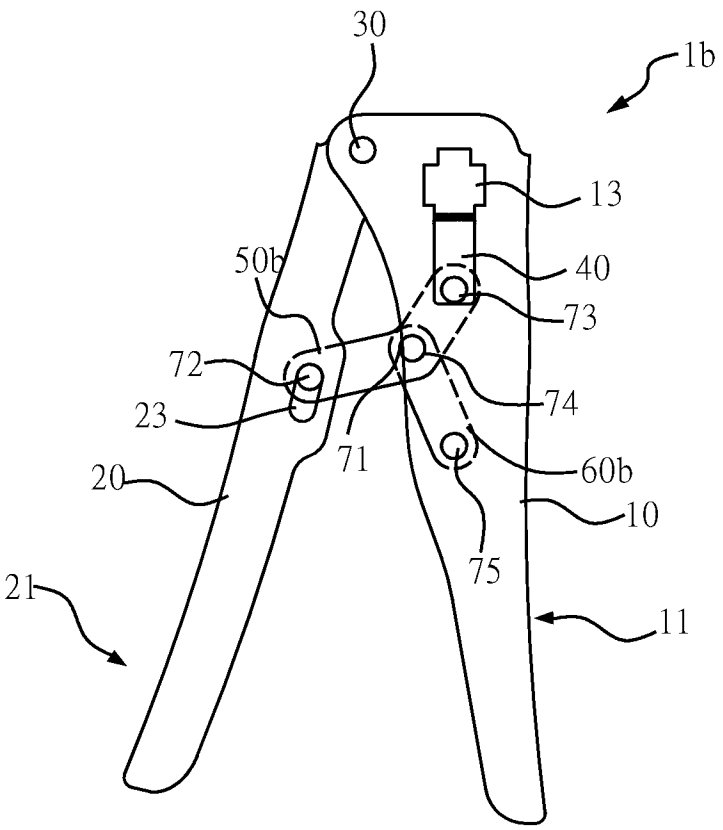
FIGS. 5A-5B illustrate an operation view of a second embodiment of the crimping tool of the present invention.
Figure 5B:
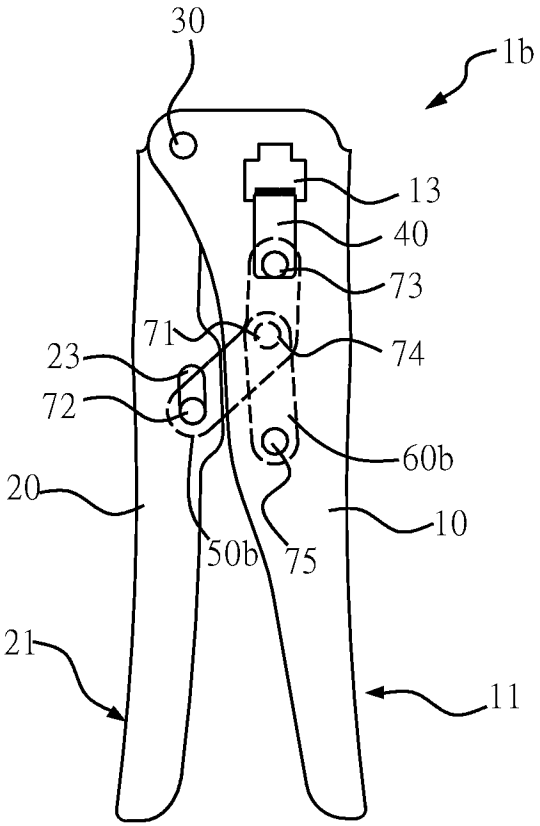

Please refer to FIGS. 5A-5B, which illustrate an operation view of the second embodiment of the crimping tool of the present invention.

In the second embodiment of the present invention, the first mechanism link 50*b* of the crimping tool 1*b* is V-shaped. The first mechanism link 50*b* is pivotally connected with a sliding hole 23 of the second handle 20 by the second pivoting portion 72, the first mechanism link 50*b* is pivotally connected with the crimping member 40 by the third pivoting portion 73, and the second mechanism link 60*b* is pivotally connected with the first handle 10 by the fifth pivoting portion 75. As a result, when the first handle 10 and the second handle 20 are pressed to be rotated with respect to each other by the shaft member 30, the second mechanism link 60*b* will also be rotated and the first mechanism link 50*b* will be rotated by the second mechanism link 60*b*. Finally, the crimping member 40 will be pushed from the first position to the second position by the first mechanism link 50*b*.

Figure 6A:
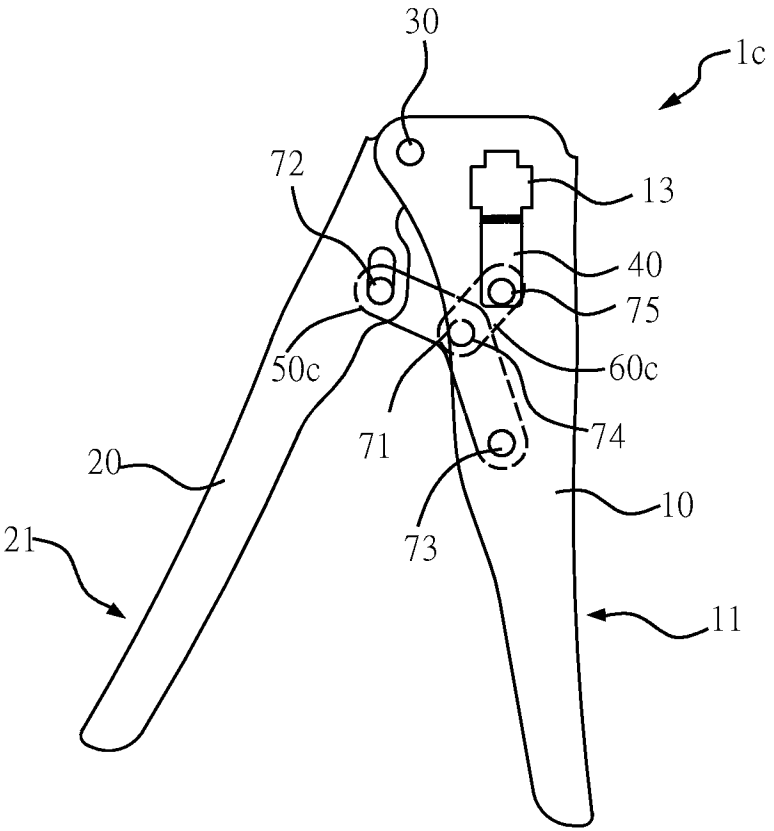
FIGS. 6A-6B illustrate an operation view of a third embodiment of the crimping tool of the present invention.
Figure 6B:
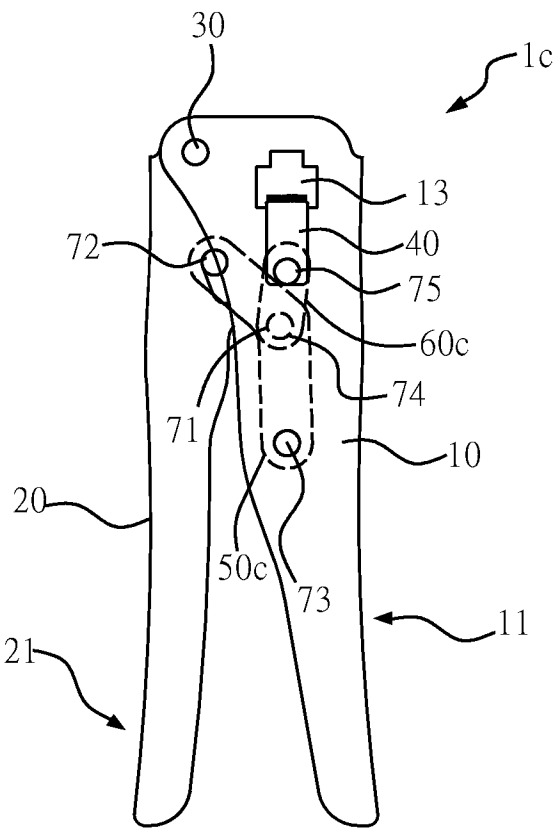

Please refer to FIGS. 6A-6B, which illustrate an operation view of the third embodiment of the crimping tool of the present invention.

In the third embodiment of the present invention, the first mechanism link 50*c* of the crimping tool 1*c* is pivotally connected with the second handle 20 by the second pivoting portion 72, the first mechanism link 50*c* is pivotally connected with the first handle 10 by the third pivoting portion 73, and the second mechanism link 60*c* is pivotally connected with the crimping member 40 by the fifth pivoting portion 75. The first pivoting portion 71 is disposed between the second pivoting portion 72 and the third pivoting portion 73. Thus, when the first handle 10 and the second handle 20 are pressed to be rotated with respect to each other by the shaft member 30, the first mechanism link 50*c* will be rotated, and the second mechanism link 60*c* will be rotated and moved at the same time by the first mechanism link 50*c*. Finally, the crimping member 40 will be pushed from the first position to the second position by the second mechanism link 60*c*.

Figure 7A:
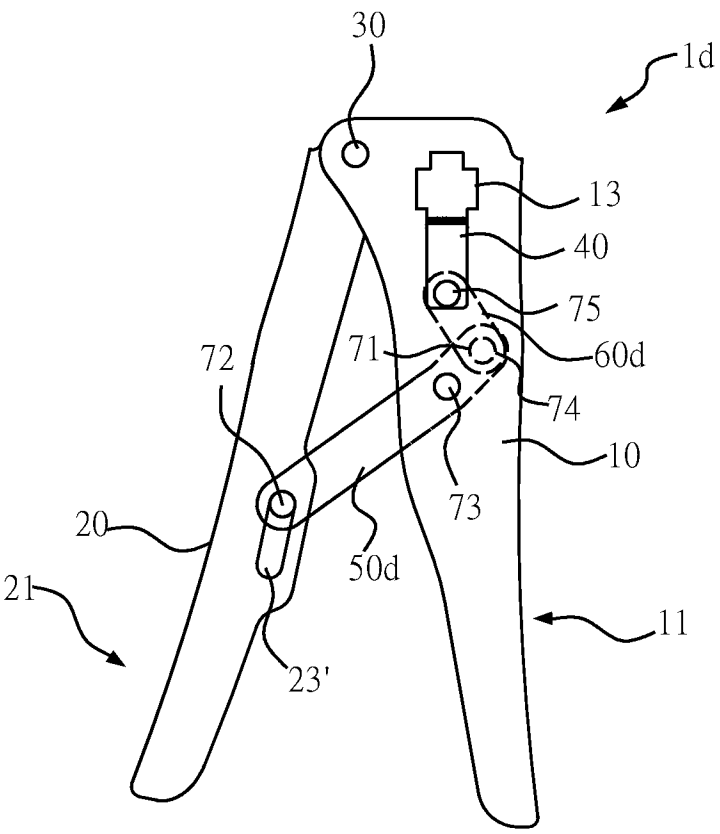
FIGS. 7A-7B illustrate an operation view of a fourth embodiment of the crimping tool of the present invention.
Figure 7B:
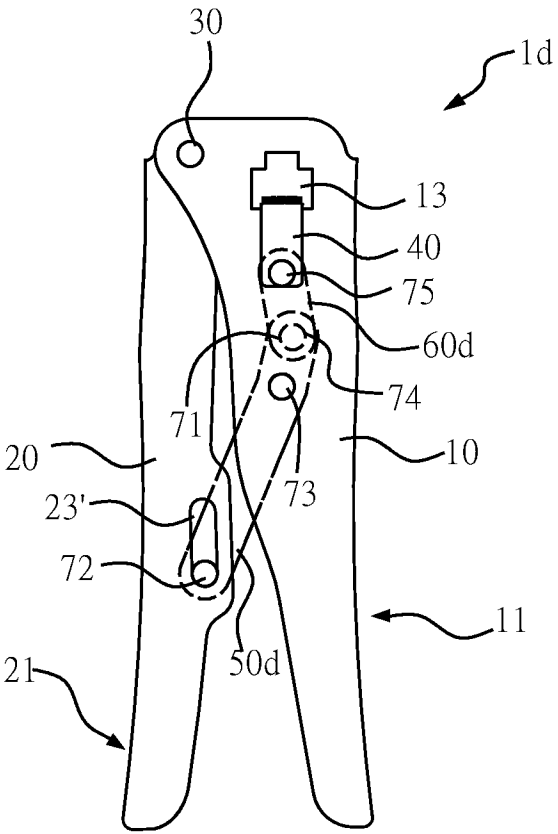

Please refer to FIGS. 7A-7B, which illustrate an operation view of the fourth embodiment of the crimping tool of the present invention.

In the fourth embodiment of the present invention, the first mechanism link 50*d* of the crimping tool 1*d* is pivotally connected with a sliding hole 23' of the second handle 20 by the second pivoting portion 72, the first mechanism link 50*d* is pivotally connected with the first handle 10 by the third pivoting portion 73, and the second mechanism link 60*d* is pivotally connected with the crimping member 40 by the fifth pivoting portion 75. The third pivoting portion 73 is disposed between the first pivoting portion 71 and the second pivoting portion 72. As a result, when the first handle 10 and the second handle 20 are pressed to be rotated with respect to each other by the shaft member 30, the first mechanism link 50*d* will be rotated at the same time, and the second mechanism link 60*d* will be rotated and moved at the same time by the first mechanism link 50*d*. Finally, the crimping member 40 will be pushed from the first position to the second position by the mechanism link 60*d*.

In addition to the mechanical components described above, the crimping tools 1*a*, 1*b*, 1*c*, and 1*d* of the present invention may include other mechanical components. Since the technology of such other mechanical components is not the focus of the present invention, it will not be described here. Moreover, the present invention is not limited to the implementation of the above-mentioned crimping tools 1*a*, 1*b*, 1*c*, and 1*d*.

As described above, the crimping tools 1*a*, 1*b*, 1*c*, and 1*d* of the present invention can eliminate wasted space and allow the user to apply force more conveniently. Therefore, the problem of the prior art can be ameliorated.

It is noted that the above-mentioned embodiments are only for illustration. It is intended that the present invention cover modifications and variations of this invention provided they fall within the scope of the following claims and their equivalents. Therefore, it will be apparent to those skilled in the art that various modifications and variations can be made to the structure of the present invention without departing from the scope or spirit of the invention.

What is claimed is:

1. A crimping tool, comprising:

a first handle comprising a hole, a first grip portion, and a first shaft portion, wherein the first shaft portion is adjacent to a top end of the first handle;

a second handle comprising a second grip portion and a second shaft portion, wherein the first shaft portion and the second shaft portion are connected by a shaft member;

a crimping member disposed at the first handle and adjacent to the hole;

a first mechanism link comprising a first pivoting portion, a second pivoting portion, and a third pivoting portion; and a second mechanism link connected with the first mechanism link, wherein the second mechanism link comprises a fourth pivoting portion and a fifth pivoting portion, wherein the first mechanism link and the second mechanism link are connected with the first handle, the second handle, and the crimping member respectively; wherein each of the pivoting portions is disposed on a pivot shaft such that the first pivoting portion of the first mechanism link is connected with the fourth pivoting portion of the second mechanism link by the same pivot shaft; thus, when the first grip portion and the second grip portion are pressed, the first handle and the second handle are rotated with respect to each other to push the crimping member to move from a first position to a second position.

2. The crimping tool as claimed in claim 1, wherein the first mechanism link comprises a first sub mechanism link and a second sub mechanism link; the first sub mechanism link and the second sub mechanism link are pivotally connected with each other and pivotally connected with the fourth pivoting portion of the second mechanism link.

3. The crimping tool as claimed in claim 2, wherein the first mechanism link is pivotally connected with the second handle by the second pivoting portion, the first mechanism link is pivotally connected with the first handle by the third pivoting portion, and the second mechanism link is pivotally connected with the crimping member by the fifth pivoting portion, such that when the first handle and the second handle are pressed and rotated with respect to each other by the shaft member, the second mechanism link pushes the crimping member to move from the first position to the second position.

4. The crimping tool as claimed in claim 3, wherein the first pivoting portion is disposed between the second pivoting portion and the third pivoting portion.

5. The crimping tool as claimed in claim 3, wherein the third pivoting portion is disposed between the first pivoting portion and the second pivoting portion.

6. The crimping tool as claimed in claim 1, wherein the first mechanism link is pivotally connected with the second handle by the second pivoting portion, the first mechanism link is pivotally connected with the first handle by the third pivoting portion, and the second mechanism link is pivotally connected with the crimping member by the fifth pivoting portion, such that when the first handle and the second handle are pressed and rotated with respect to each other by the shaft member, the second mechanism link pushes the crimping member to move from the first position to the second position.

7. The crimping tool as claimed in claim 6, wherein the first pivoting portion is disposed between the second pivoting portion and the third pivoting portion.

8. The crimping tool as claimed in claim 6, wherein the third pivoting portion is disposed between the first pivoting portion and the second pivoting portion.

9. The crimping tool as claimed in claim 1, wherein the first mechanism link is pivotally connected with the second handle by the second pivoting portion, the first mechanism link is pivotally connected with the crimping member by the third pivoting portion, and the second mechanism link is pivotally connected with the first handle by the fifth pivoting portion, such that when the first handle and the second handle are pressed and rotated with respect to each other by the shaft member, the first mechanism link pushes the crimping member to move from the first position to the second position.

10. The crimping tool as claimed in claim 1, wherein the second handle further comprises a sliding hole for allowing the second pivoting portion of the first mechanism link to slide within the sliding hole.

11. The crimping tool as claimed in claim 1, wherein the first handle comprises a sliding rail to allow the crimping member to move.

12. The crimping tool as claimed in claim 1, wherein an elastic element is further disposed between the first handle and the second handle to provide an elastic force after the first handle and the second handle are pressed.

* * * * *